United States Patent [19]

Anderson

[11] 3,951,500

[45] Apr. 20, 1976

[54] CIRCULAR RACK AND PANEL CONNECTOR

[75] Inventor: Norman Richard Anderson, Cicero, Ill.

[73] Assignee: Bunker Ramo Corporation, Oak Brook, Ill.

[22] Filed: Mar. 17, 1975

[21] Appl. No.: 558,833

Related U.S. Application Data

[63] Continuation of Ser. No. 477,663, June 10, 1974, abandoned, which is a continuation of Ser. No. 328,866, Feb. 1, 1973, abandoned.

[52] U.S. Cl. ..... 339/64 M; 339/65; 339/186 M

[51] Int. Cl.[2] ..... H01R 13/62

[58] Field of Search ..... 339/64–66, 339/184, 186, 187

[56] References Cited

UNITED STATES PATENTS

| | | | |
|---|---|---|---|
| 2,871,457 | 1/1959 | Jencks et al. | 339/64 M |
| 3,094,364 | 6/1963 | Lingg | 339/64 M |
| 3,116,959 | 1/1964 | Abodeely | 339/66 M |
| 3,181,104 | 4/1965 | Oxley | 339/64 M |
| 3,287,031 | 11/1966 | Simmons et al. | 339/65 |
| 3,325,771 | 6/1967 | Ruehlemann et al. | 339/184 M |

*Primary Examiner*—Joseph H. McGlynn
*Attorney, Agent, or Firm*—William Lohff; F. M. Arbuckle

[57] ABSTRACT

A circular electrical connector of the type having mating plug and receptacle members, one of the members being spring mounted on a rigid rack and the other being mounted on heavy electronic equipment to be housed in the rack and electronically interconnected to external conductors through the connector, the members being equipped with horizontally positioned alignment support means which prevent mating engagement of the members until they are in proper axial alignment. The alignment means also support the weight of the equipment associated with the plug or receptacle member to prevent damage to the electrical contacts housed therein. The alignment means are located radially outwardly of the mating shells of the connector so as to permit connection of the receptacle member to a test connector having a standard coupling ring with helically shaped bayonet pin accommodating slots. The alignment means are supported on or adjacent to lugs which are movable in slots in a rigid housing around the spring to restrain rotational movement of the mating shell and contacts housed therein while permitting the desired longitudinal spring action. The receptacle member is equipped with bayonet pins which fit into longitudinally straight guide slots on the plug member.

7 Claims, 8 Drawing Figures

CIRCULAR RACK AND PANEL CONNECTOR

BACKGROUND OF THE INVENTION

This is a continuation application of continuation application Ser. No. 477,663 filed June 10, 1974, now abandoned which is a continuation of Ser. No. 328,866 filed Feb. 1, 1973, now abandoned.

In rack and panel connectors, one of the connector members is often mounted in a rack-type housing while the other member is panel mounted on electrical or electronic equipment designed to be housed or supported by the rack with the connector members being interconnected by rearward movement of the equipment into the rack. Each connector member usually includes a multitude of electrical contacts arranged in a particular pattern for predetermined engagement with contacts in the other member.

These connectors have included both rectangular and circular types with each type having certain advantages. While the rectangular type has an outer housing shaped to orient the contacts in the desired arrangement, the circular type in many instances is better designed to accommodate conductors having outer shielding.

Circular rack and panel connectors have been constructed with one connector member spring loaded on a rigid mounting to permit some rearward movement of the connector members after being electrically coupled. In a construction of this type, complete electrical engagement between the contacts can be accomplished without dependence on the exact rearward positioning of the equipment in the rack.

One of the problems with circular rack and panel connectors has been associated with alignment of the two connector members prior to the coupling action. The contacts and outer shells of these members are often relatively fragile compared to the weight of the equipment and force developed during this rearward movement in the rack. Therefore, it is important that the correct alignment of the members be accomplished before engagement between the respective shells and contacts occurs, to avoid damage to various portions of the connector members.

SUMMARY OF THE INVENTION

This invention is directed to a circular electrical connector of the rack and panel type having alignment and supporting means which align and support the connector members before their contacts can be mated.

The connector of this invention includes first and second members such as a receptacle member and a plug member with one member mounted on a unit of electrical or electronic equipment and the other member mounted on a panel for connection to the first member. In practice, the electrical or electronic equipment may be relatively heavy and attempts at mating the connector members can often cause damage to one or both of the members.

In order to facilitate the connection of the plug and receptacle members and to prevent damage to them, a pair of guide pins are disposed in a horizontal plane on radially opposite outer sides of the connector shell of the rack mounted connector member with the guide pins extending a considerable distance beyond the mating ends of the connector shell. In the embodiments shown in the drawings, the guide pins are mounted on a flange which is attached to the connector shell. The guide pins engage guide openings in a mounting flange on the other connector member. The guide pins and guide openings are tapered at their forward ends to accommodate a small amount of angular misalignment of the guide pins during insertion into the guide openings. The positioning of the guide pins on a flange radially outwardly of the circular plug and receptacle sleeves permits the use of guide pins which are sufficiently long to engage the guide openings before the mating portions of the connector engage each other and also permits the use of pins of large enough diameter to support the weight of the equipment on which the connector members are mounted.

The spacing of the guide pins and guide openings radially outwardly of the connector sleeves permits the panel receptacle to receive a standard circular bayonet plug connector for testing purposes. To receive and hold such a connector, the receptacle member is provided with bayonet pins on the receptacle sleeve.

In a preferred embodiment of the invention, the guide pins are rack mounted rather than equipment mounted to prevent damage to the guide pins due to rough handling of the equipment.

An advantage of the invention is that the guide pins can be made sufficiently long to prevent even angular contact of the telescoping sleeves of the plug and receptacle until mating alignment of the guide pins is achieved.

Another advantage is that grounding clips may be provided on the outer periphery of the mating sleeve of one of the members to provide grounding contact between the members before the contacts mate.

Another advantage of this invention resides in that the guide pins may be installed on either the rack or the panel.

Another feature of the invention is that polarizing pins may be provided along with the guide pins.

Another advantage is that the guide pins may be attached to a connector part which is floatably mounted on its supporting rack.

Another advantage is that the guide pins may be rigidly mounted on the panel and the guide pin receiving openings may be floatably mounted on the rack.

Another advantage is that the guide pins are aligned with the rack float spring so that forces applied to the guide pins are transmitted directly to the float spring.

Another advantage is that the guide pins and guide openings are mounted on flanges having lugs which are disposed to move in longitudinal slots formed in the housing for the rack mounted spring so that the guide members and their shell are restrained rotationally while being free to deflect longitudinally.

Another advantage is that guide pins rigidly mounted on a panel may extend through the rack spring housing without interfering with the springs.

Other objects and advantages of the invention will be found in the following specification, claims and drawings.

DESCRIPTION OF THE PREFERRED EMBODIMENTS

Figure 1:
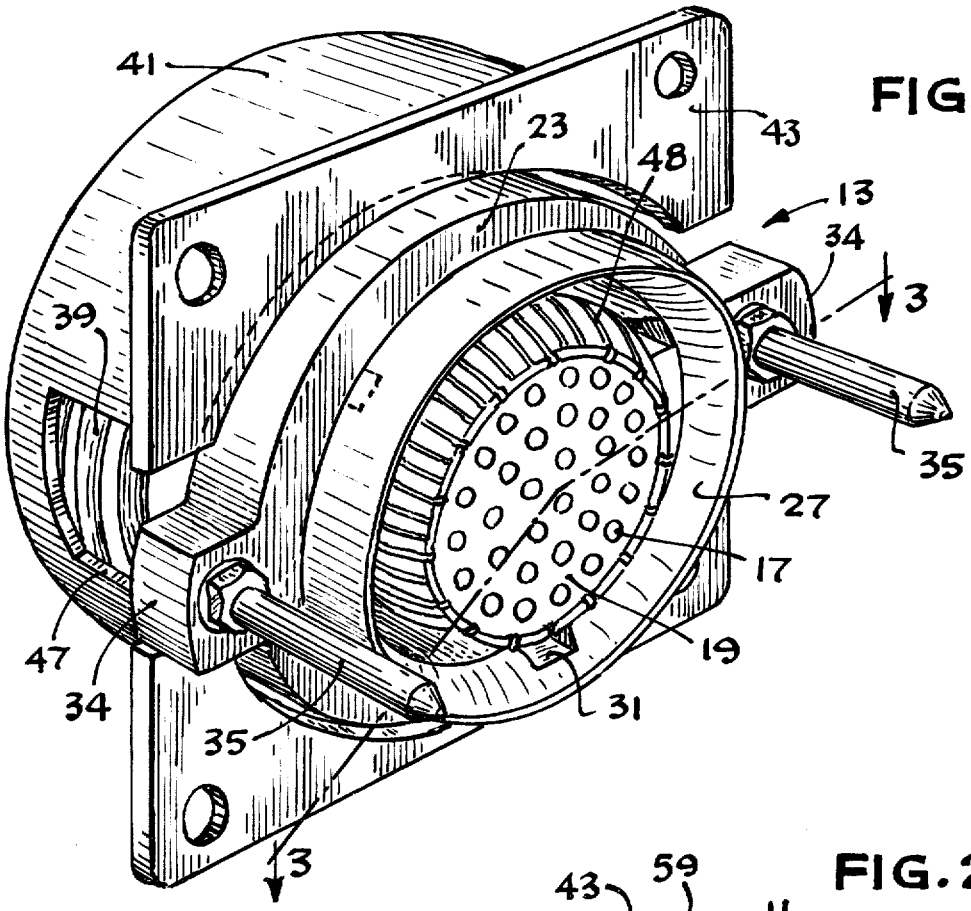
FIG. 1 is a perspective view of a rack mounted connector plug member embodying the novel features of this invention.
Figure 2:
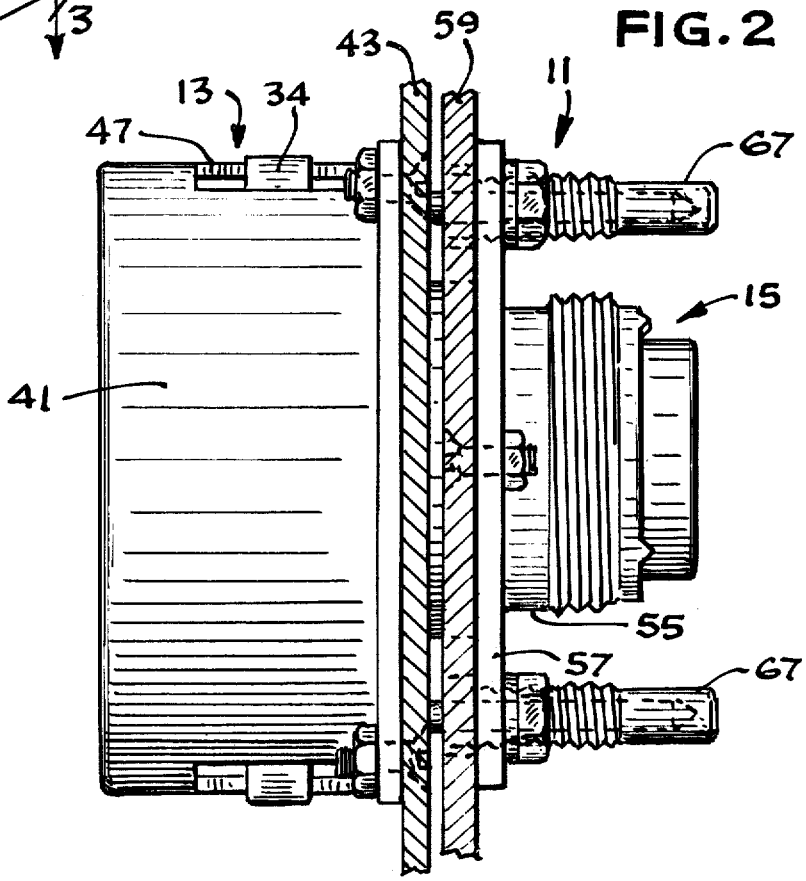
FIG. 2 is a top plan view of the rack mounted connector plug member of FIG. 1 connected to a panel mounted receptacle member.
Figure 3:
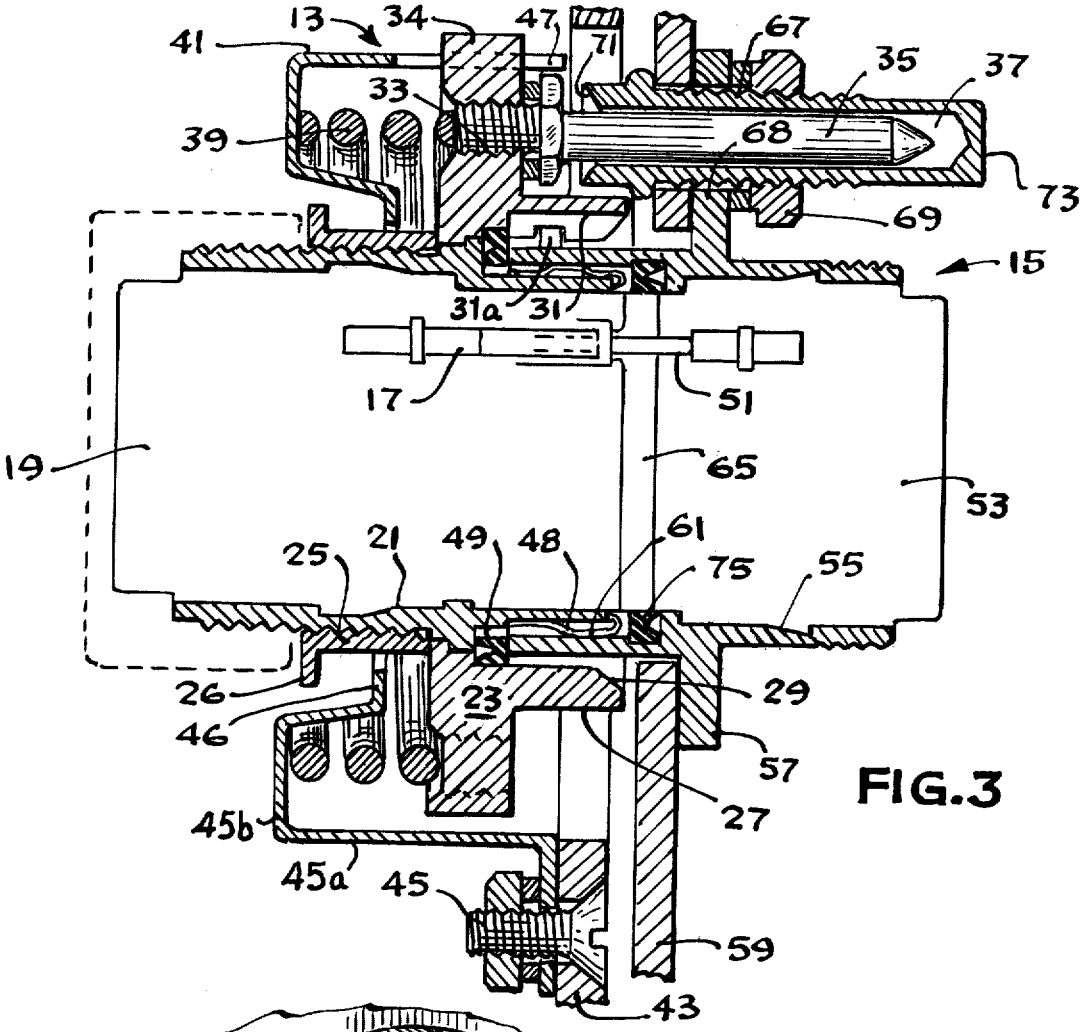
FIG. 3 is a cross-sectional view taken along line 3—3 of FIG. 1 but showing the plug and receptacle members connected as in FIG. 2.

FIGS. 1, 2 and 3 of the drawings shows one embodiment of an electrical connector assembly or a circular rack and panel connector 11 made in accordance with the teachings of this invention. The connector 11 includes a plug member 13 and a receptacle member 15 which telescopingly engage each other. The plug member 13 which is rack mounted includes contacts or pin sockets 17 imbedded in a dielectric insert 19. The dielectric insert is contained in and surrounded by a tubular metal shell 21. A flange member 23 fits over the shell and is held in position thereon by a nut 25 which threads on the plug shell. The nut has an outwardly projecting annular lip 26 at the rear end thereof.

Formed as part of the flange member 23 is a forwardly extending sleeve 27 having a tapered funnel entrance 29. Formed in the tapered funnel entrance of the sleeve are straight guide slots 31 for receiving bayonet pins such as 31*a* on the receptacle member 15. Bayonet pins 31*a* are provided on the receptacle 15 for receipt in a conventional bayonet type coupling means such as the pin receiving or bayonet sockets formed in a rotatable coupling ring on a test plug connector. The receptacle 15 therefore mates with either such bayonet type connector plug member or with the connector member 13. Threaded openings 33 are formed in diametrically opposed lugs 34 which are part of the flange. The openings receive guide or alignment pins 35 and also serve in some instances as a means for mounting the flange to a rigid support. The guide pins project a considerable distance forward of the sleeve 27 and terminate in tapered points 37. The guide pins are advantageously arranged to lie in a horizontal plane to provide horizontally separated supporting guides for a receptacle member which is often on a heavy mounting. The receptacle member is usually tilted or inclined upwardly during connection so that it is more likely to strike and be damaged by the guide pins if they are vertically aligned above and below the plug member. Horizontal misalignment of the receptacle member usually is not a problem; so placing the guide pins on opposite sides horizontally of the plug member positions them where they are less likely to damage the receptacle member during connection.

A coil spring 39 bears against the flange 23 and is enclosed in a shroud-like housing 41 which is mounted on a support element or rack 43 by threaded fasteners 45. The housing 41 has an annular wall 45*a* and a transverse back wall 45*b* extending radially inwardly of the annular wall 45*a*. The coil spring aligns with the threaded openings 33, placing the spring directly behind and radially coincident with each of the guide pins 35 so that forces applied to the guide pins upon connection of the members will be transmitted directly to the spring thereby minimizing tilting of the flange 23 if the forces applied to the opposite guide pins are unequal. The housing has an inwardly projecting lip 46 which engages the lip 26 of the locking nut to limit movement of the plug member shell 21 relative to the housing. The housing is formed with cut-out slots 47 extending axially in the housing annular wall and which receive the flange lugs 34 to permit the shell 21 to move axially or longitudinally relative to the housing but prevents rotation of these parts relative to each other in response to the telescoping engagement of the receptacle member and the plug member.

Grounding spring clips 48 are attached to the shell 21 near the forward end thereof and are located inwardly of the sleeve 27. An environmental seal 49 is positioned between the shell 21 and the sleeve 27.

Figure 7:
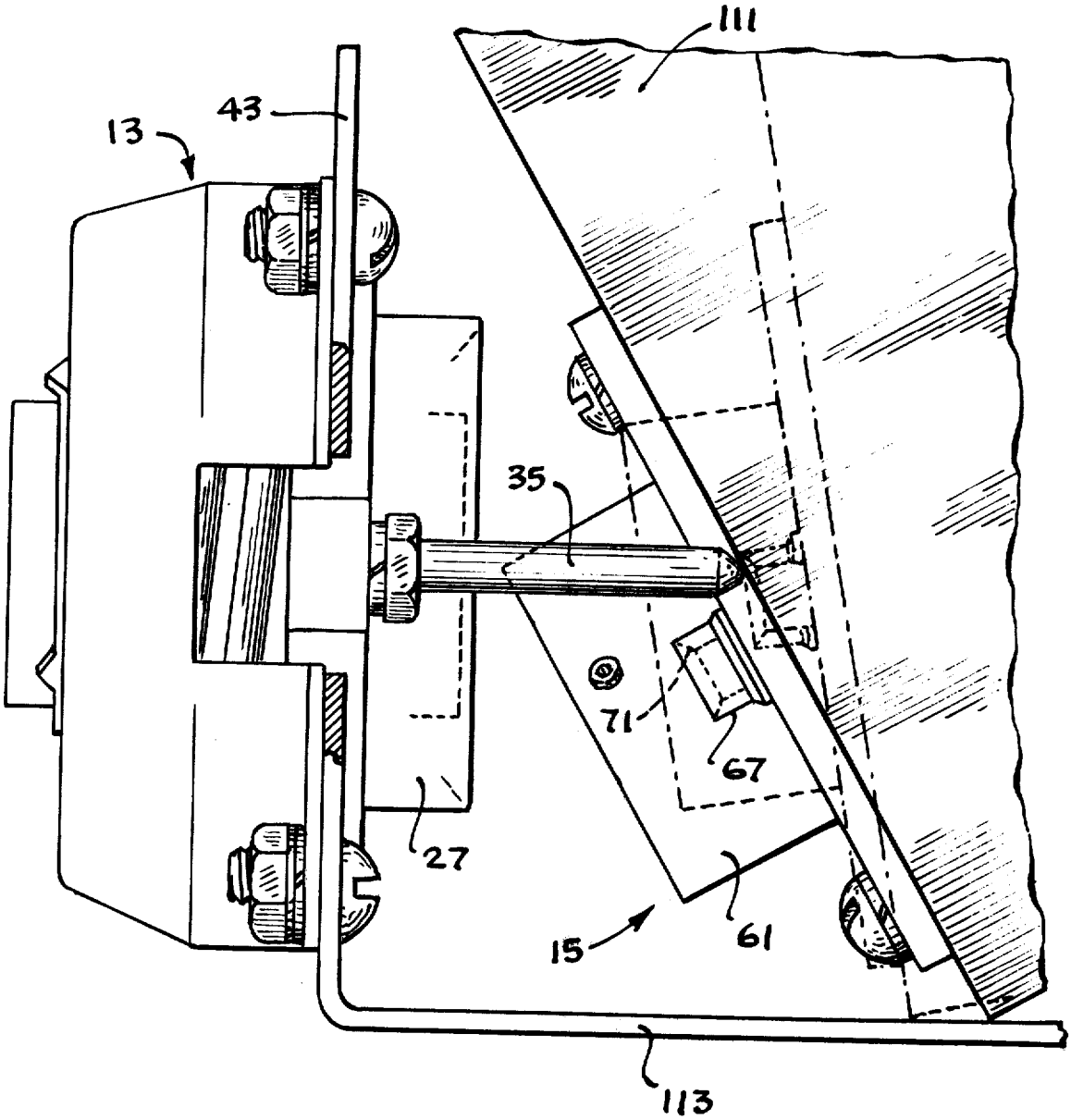
FIG. 7 is a side elevational view showing the guide pins engaging a piece of misaligned equipment to prevent the receptacle sleeve from contacting the plug sleeve.

The panel mounted receptacle 15 includes pin contacts 51 positioned in a dielectric insert 53 surrounded by a metallic shell 55. The shell has a flange 57 which is mounted on a panel 59. The shell includes a receptacle sleeve 61 which extends forwardly of the dielectric insert 53 through a panel opening aligned with the sleeve 61 and is of such a diameter that it telescopes inside the plug sleeve 27 and has a cylindical or annular end, which encircles and receives the cylindrical or annular end of the plug shell 21 aligned with the rack opening 21, thereby contacting the grounding spring clips 48. The flange or flange member 23 as seen in FIG. 3 is transverse to the plug shell and extends radially outwardly from the plug shell. Flange 23 is also spaced from the plug shell cylindrical end with the flange 23 located between the back wall 45*b* of the housing 41 and the support element 43 as also depicted in FIG. 3. The spring 39 is located between the flange 23 and the wall 45*b* and thus biases or moves the shell 21 in the direction of the opening in the support element 43 with the stop means 26 limiting movement in a direction from the opening in the support element. A seal 65 is located at the face of the receptacle dielectric insert 53 and contacts the dielectric insert 19 of the plug. Guide bushings or sockets 67 are located in openings 68 formed in the receptacle flange 57 and are held in position by locking nuts 69. The guide bushings have tapered entrances 71 and may be equipped with closed ends 73. The guide bushings are arranged to lie with the longitudinal axis of each pin in a common horizontal plane 180° apart to receive the guide pins 35 which are oriented in a similar manner and limit the angle of engagement between the guide pins and the bushings to said plane as best seen in FIG. 7. The guide pins 35 are spaced radially outwardly a predetermined distance of the cylindrical end of the shell 21, while the bushings 67 secured to the shell 55 are spaced correspondingly to the guide pins 35 for each receiving a respective one of the guide pins. The pins and bushings form respective axial and angular alignment means and are fixedly attached on a respective shell. It will be noted that the guide bushings 67 are spaced axially relative the shell 55 for receiving the guide pins 35 prior to the telescoping engagement of the cylindrical shell ends as may be seen by reference to FIGS. 3, 5 and 7, which in turn engage before the contacts 17 and 51 engage. A peripheral seal 75 aligns with the receptacle base seal 65 to function when a conventional plug is connected to the receptacle.

Figure 3A:
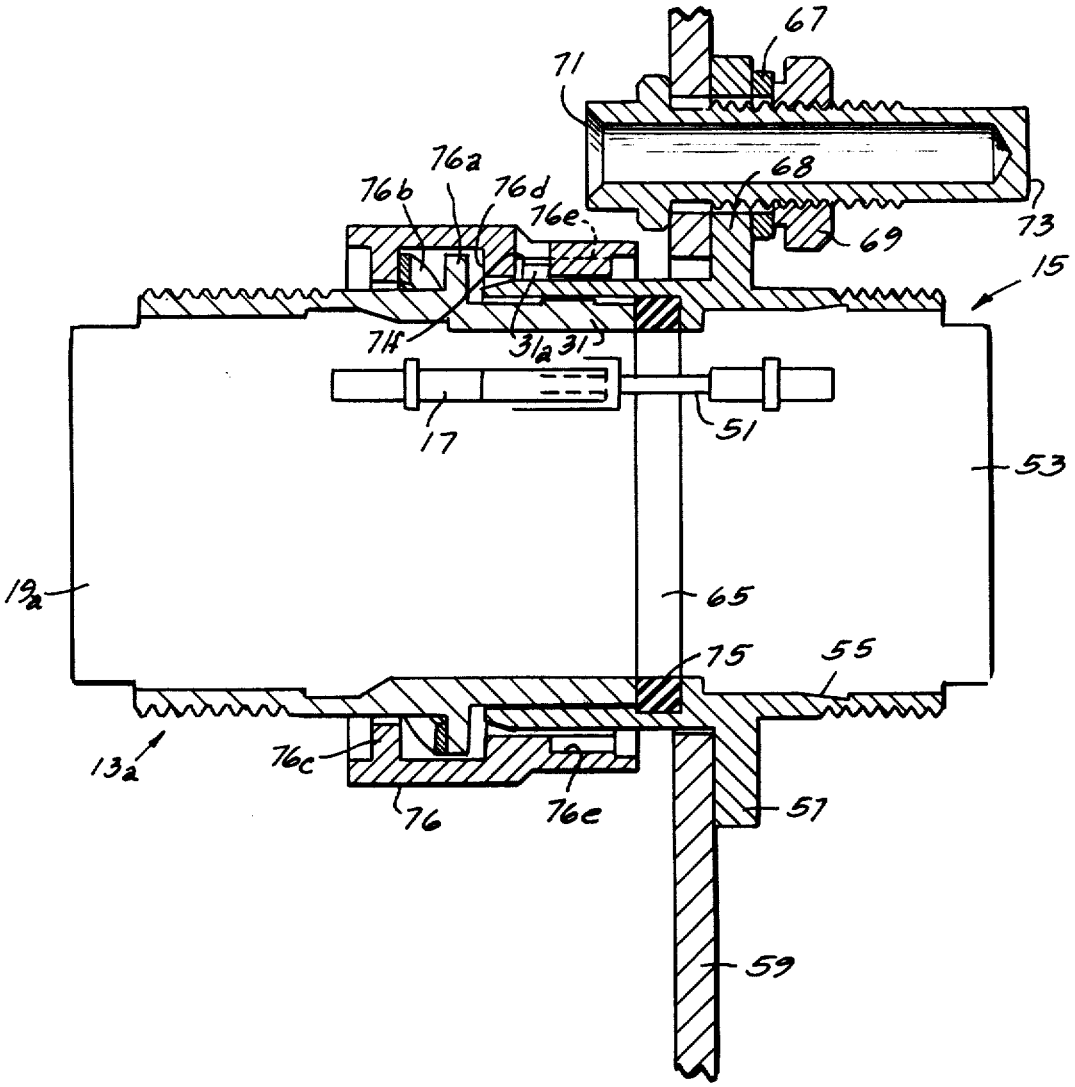
FIG. 3*a* is a sectional view similar to FIG. 3, but illustrating the receptacle member engaging with a conventional plug member having a rotatable coupling ring.

FIG. 3*a* illustrates a receptacle member identified by the character 15 having alignment means such as the guide bushings 67. Receptacle member 15 is shown engaged with a conventional connector such as 13*a* carrying a conventional rotatable coupling ring 76. Similar parts of the receptacle or connector 15 and connector 13*a* to those shown in FIG. 3 are generally identified in FIG. 3*a* by similar reference characters. The connector 13*a* carries a dielectric insert 19*a* in which contacts such as 17 are mounted for engagement with contacts such as 51 of the receptacle 15. The connector 13*a* has a conventional shoulder 76*a* with a wave washer 76*b* engaging one side of the shoulder 76*a* to bias a retaining ring 76*c* conventionally secured at the rear end of the coupling ring 76 by a C ring (not shown) or a force fit to, in turn, normally bias a shoulder 76*d* on the ring 76 against the shoulder 76*a*. The ring 76 has a conventional cam track or bayonet coupling means 76*e* at the forward end thereof and when connectors 15 and 13*a* are engaged, the cam track 76*e* is engaged with the pin 31*a*. Usually, a plurality of circumferentially spaced cam tracks and circumferentially spaced bayonet pins are provided. Rotation of the coupling ring 76 and the track 76*e* or bayonet coupling means then moves the connector 13*a* axially in the direction of the receptacle 15 to securely engage the contacts, while the ring 76 moves an additional increment against the bias of the spring washer 76*b* until the pin 31*a* reaches the detent portions 71*f* of the coupling ring cam track. At that time, the shoulder 75*d* and 76*a* are separated.

Figure 4:
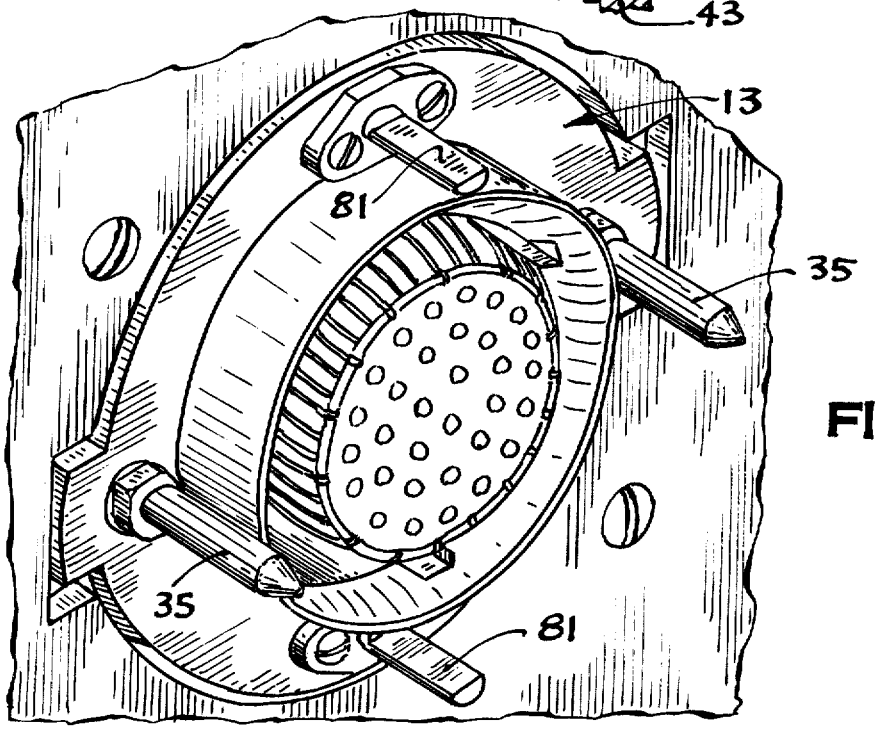
FIG. 4 is a perspective view of a rack mounted plug member having polarizing pins.

FIG. 4 shows a plug member 13 of FIG. 1 equipped with polarizing pins 81. In this example, the polarizing pins are located diametrically opposite of one another and at right angles to the alignment and supporting guide pins 35. As can be seen in FIG. 4, the polarizing pins 81 have a flat surface and by detaching the pins and rotating the same 180° about the respective axes, the flat surface may be oriented 180° from that illustrated so that the flat surface may have either of two angular locations for providing corresponding polarization effects.

Figure 5:
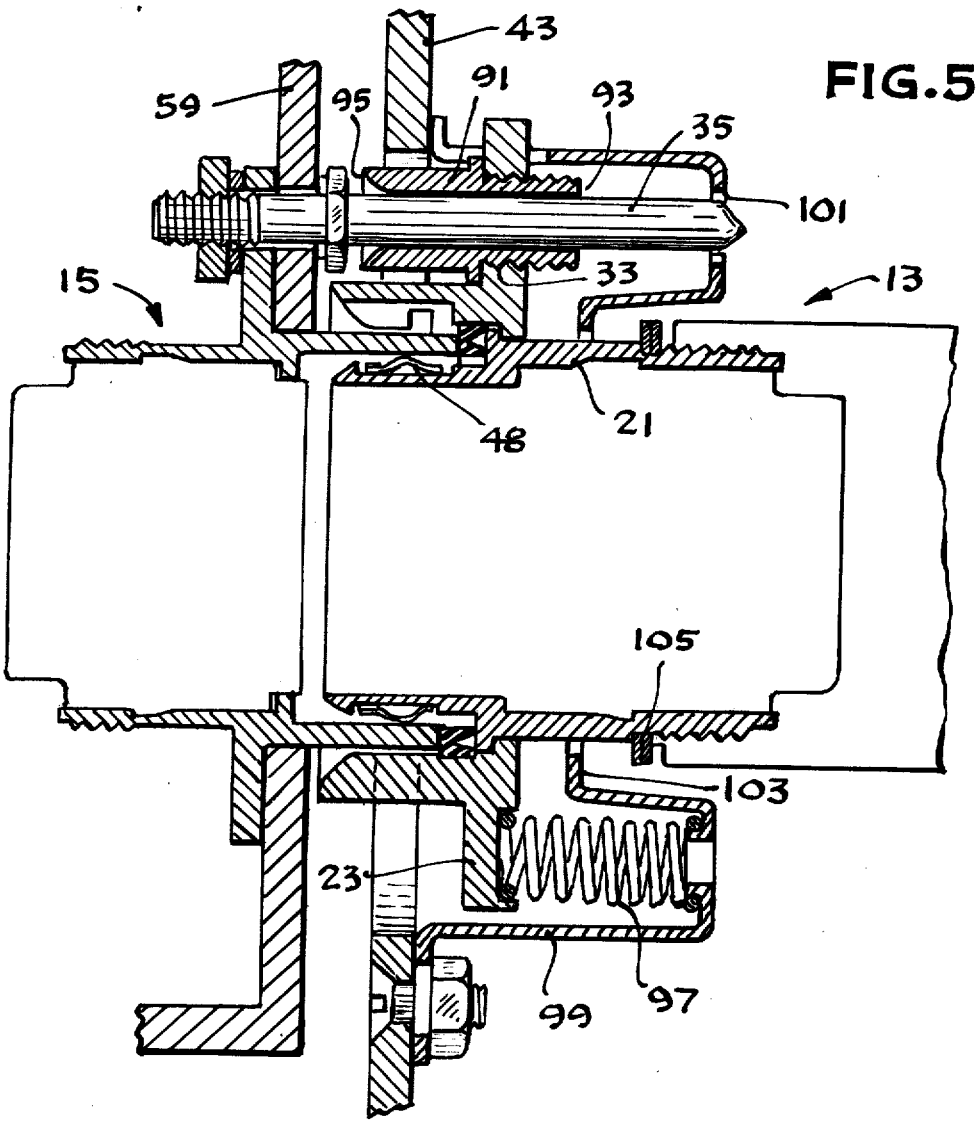
FIG. 5 is a cross-sectional view of a modified form of the invention in which the aligning guide pins are attached to a panel mounted receptacle member.

A modified embodiment of the invention is shown in FIG. 5 of the drawings in which the alignment or guide pins 35 are mounted on the panel 59 carrying the receptacle member 15 and guide bushings or sockets 91 are mounted on the rack 43 carrying the plug member 13. In this modification, the guide pins receiving sockets 91 are threaded into the openings 33 in the flange 23 of the plug shell 21. The sockets are open at their ends 93 opposite to their entrances 95 to permit the pins to extend through the sockets. A plurality of coil springs 97 spaced circumferentially about the plug shell 21 are each compressed between the flange 23 and the back wall of a housing 99 which is fastened to the rack 43. The number of coil springs used may be varied, but the springs are spaced so as not to obstruct the guide pins 35. The housing has openings 101 in the rear thereof which align with the guide pins 35 permitting the guide pins to extend through the housing. The housing has an inwardly projecting lip 103 to limit forward movement of the receptacle by engaging the lock rings 105 mounted on the shell 21.

Figure 6:
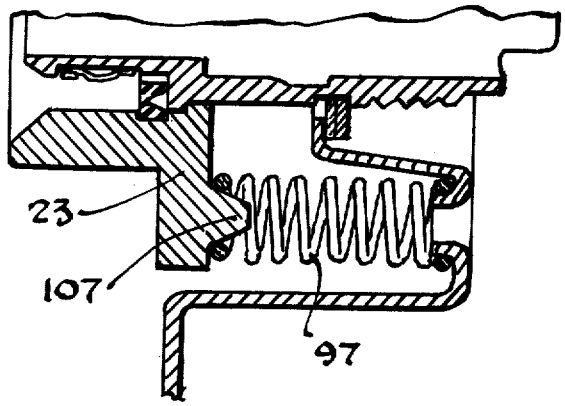
FIG. 6 is a partial cross-sectional view of a modified form of the rack float spring arrangement of FIG. 5.

A modified form of coil spring mounting is shown in FIG. 6 of the drawings in which the coil springs 97 are seated on projections 107 formed as part of the flange 23. The projections determine the spacing of the springs and also anchor the springs.

FIG. 7 shows a plug member 13 mounted on a rack 43 and a receptacle 15 mounted on equipment 111. The rack 43 has a bed 113 formed integrally therewith and extending at right angles thereto. When the equipment is moved toward the rack at an improper angle of orientation, the guide pins 35 will contact the equipment before the receptacle sleeve 61 can contact and damage the plug sleeve 27. In this drawing, the equipment 111 is tilted at an angle of 30° relative to the bed 113. At this angle, the guide pins 35 contact the equipment 111 before the sleeve 61 contacts the sleeve 27 thereby preventing damage to the pins and pin contacts.

When the equipment is tilted to an angle of 0°–10° relative to the bed 113, the guide pins 35 will engage the tapered entrance surfaces 71 of the guide bushings 67 and will thereby properly align the receptacle sleeve with the plug sleeve for proper engagement of their respective pin and socket contacts.

Thus it will be seen that the rack 43 provides a wall supporting the rotatably mounted shell 21 and that the rack 43 has a passageway circumferentially or peripherally encircling or circumscribing the shell, alignment means 35, flange member 23, spring 39 and polarizing means 81 as seen in FIGS. 1, 3 and 4 and that the passageway circumscribes the guide means 67, which together with the receptacle 15 are mounted on the panel or wall 59.

I claim:

1. An electrical connector assembly for use with a pair of spaced support elements each having an opening and adapted for relative movement toward each other for engaging each contact of a plurality of contacts carried by a plug member having a generally annular end projecting beyond one end of said contacts with a respective contact of a plurality of contacts carried by a receptacle member with said receptacle member having a generally annular end projecting beyond one end of the contacts carried by said receptacle member for telescopingly engaging said plug member annular end in response to the relative movement of said support elements toward each other, comprising:

a housing having an annular wall encircling one of said members with an axially extending slot in said annular wall and a transverse back wall extending radially inwardly of said annular wall, means for fixing said housing to one of said support elements with said back wall spaced from said one support element, a flange fixed on the one of said members and extending radially outwardly of the annular end of said one member and spaced intermediate the annular end of said one member and the other end of said one member, said flange located between said one support element and said back wall with the annular end of said one member aligned with the opening in said one support element, spring means engaged with said back wall and with said flange for biasing said one member axially in the direction of the opening in said one support element, means integrally formed on said flange and engaged in said slot in said annular wall for preventing relative rotation between said one member and said housing in response to the telescoping engagement of said plug and receptacle member and the axial movement of said plug and receptacle members against the bias of said spring means, and a plurality of guide pins secured to said flange on said one member with said guide pins spaced radially intermediate the annular wall of said housing and the cylindrical end of said one member and projecting in one direction beyond the cylindrical end of said one member to which said guide pins are secured.

2. In the connector assembly claimed in claim 1, a flange fixed on said other member extending radially outwardly of the cylindrical end of said other member and having openings therein spaced circumferentially and radially in positions corresponding to said guide pins, a plurality of guide bushings each passing through a respective opening of the flange fixed on the other member, and means formed on each guide bushing for securing each bushing and the flange fixed on said other member to the other of said support elements with the annular end of said other member in alignment with the opening in the other support element and said guide bushings spaced circumferentially and radially of said other member in respective positions corresponding to said guide pins for receiving a respective one of said guide pins, said guide bushings spaced axially relative said other member for receiving said pins prior to the telescoping engagement of said annular ends for preventing misalignment between the contacts of said plug member and said receptacle member in response to relative movement of said support elements toward each other for engaging the contacts of said plug member with the contacts of said receptacle member.

3. The assembly claimed in claim 1, in which said integrally formed means to prevent rotation between said housing and said one member includes a lug on said flange engaged in said slot extending axially in said housing annular wall, and said spring means comprises a coil spring having a coil radially coincident with each guide pin to provide a force resisting tilting movement of the respective guide pins.

4. An electrical conductor assembly for use with a pair of spaced support elements each having an opening and movable toward each other for engaging each contact of a plurality of contacts carried by a plug member having a generally annular end projecting beyond one end of said contacts with a respective contact of a plurality of contacts carried by a receptacle member with said receptacle member having a generally annular end projecting beyond one end of the contacts carried thereby for telescopically engaging said plug member annular end in response to relative movement of said support elements toward each other, comprising:

a housing fixed to one of said support elements and having an annular wall encircling one of said members with an axially extending slot in said annular wall and a transverse back wall spaced from said one support element and extending radially inwardly of said annular wall, a first flange fixed on the one of said members and extending radially outwardly therefrom and spaced intermediate the annular end of said one member and the other end of said one member, said first flange located between said one support element and said back wall with the annular end of said one member aligned with the opening in said one support element, a second flange fixed on the other of said members and extending radially outwardly therefrom and spaced intermediate the annular end of said other member and the other end of said other member, said second flange located between the other support element and said other end of said other member with said other member aligned with the opening in said other support element, said other member fixed to said other support element, spring means engaged with said back wall and with said first flange for biasing said one member axially in the direction of the opening in said one support element, means integrally formed on said first flange and engaged in said slot in said annular wall for preventing relative rotation between said one member and said housing in response to the telescoping engagement of said plug and receptacle members and the axial movement of said plug and receptacle members against the bias of said spring means, a plurality of guide pins secured to one of said flanges and projecting in one direction beyond the cylindrical end of the corresponding member to which that flange is fixed, and a plurality of guide bushings secured to the other of said flanges to receive said guide pins prior to engagement of said annular ends of said plug and receptacle members.

5. An electrical connector assembly as claimed in claim 4, comprising bayonet pins carried by and extending radially from said annular end of said plug member for cooperable engagement with a bayonet coupling nut of an additional connector when said receptacle member is disengaged from said plug member.

6. An electrical connector assembly as claimed in claim 4, comprising bayonet pins carried by and extending radially from said annular end of said receptacle member for cooperable engagement with a bayonet coupling nut of an additional connector when said plug member is disengaged from said receptacle member.

7. An electrical connector assembly for use with a pair of spaced support elements adapted for relative movement toward each other for engaging each contact of the plurality of contacts carried by a plug member having a generally annular end projecting beyond one end of said contacts with a respective contact of a plurality of contacts carried by a receptacle member with said receptacle member having a generally annular end projecting beyond one end of the contacts carried by said receptacle member for telescopically engaging said plug member annular end in response to relative movement of said support elements toward each other, comprising:

a spring retainer fixed to one of said support elements and having a transverse back wall spaced from said one support element, a flange fixed on the one of said members and extending radially outwardly of the annular end of said one member and spaced intermediate the annular end of said one member and the other end of said one member, said flange located between said one support element and said back wall, spring means engaged with said back wall and with said flange for biasing said one member axially in the direction away from said back wall, means integrally formed on said flange and engaged with said spring retainer for preventing relative rotation between said one member and said housing in response to the telescoping engagement of said plug and receptacle members and the axial movement of said plug and receptacle members against the bias of said spring means, and a plurality of guide pins secured to said flange on said one member with said guide pins spaced intermediate said spring retainer and the cylindrical end of said one member and projecting in one direction beyond the cylindrical end of said one member to which said guide pins are secured.

* * * * *